United States Patent [19]

Werner

[11] 4,425,674

[45] Jan. 17, 1984

[54] TRANSMISSION FOR ADJUSTABLE HOSPITAL BED

[75] Inventor: Lester W. Werner, St. Louis, Mo.

[73] Assignee: B-W Health Products, Inc., Maryland Heights, Mo.

[21] Appl. No.: 211,549

[22] Filed: Dec. 1, 1980

[51] Int. Cl.[3] ..... A61G 7/00

[52] U.S. Cl. ..... 5/68; 5/66; 74/471 R

[58] Field of Search ..... 5/60, 63, 66–69; 74/471 R

[56] References Cited

U.S. PATENT DOCUMENTS

| | | | |
|---|---|---|---|
| 3,216,026 | 11/1965 | Mann | 5/66 |
| 3,465,373 | 9/1969 | Wilson | 5/63 |
| 3,808,613 | 5/1974 | Carpentier et al. | 5/63 |
| 4,094,024 | 6/1978 | Benoit et al. | 5/66 |
| 4,110,856 | 9/1978 | Benoit et al. | 5/68 |
| 4,324,010 | 4/1982 | Houlberg et al. | 5/68 |

*Primary Examiner*—Alexander Grosz
*Assistant Examiner*—Michael F. Trettel
*Attorney, Agent, or Firm*—Gravley, Lieder & Woodruff

[57] ABSTRACT

Different hospital bed adjustments (such as high-low, back and knee adjustments) may be made simultaneously with a transmission that transmits power from a single rotating drive to selected ones of a series of independently rotatable output shafts or drive screws, each of which controls a different bed adjustment. Each of the drive screws may be individually clutched to the rotating drive independently of the other drive screws. With this arrangement, a plurality of drive screws may be clutched at the same time in order to effect concurrent operation of a plurality of adjustment mechanisms thereby obtaining rapid re-positioning of the hospital bed to a new position.

13 Claims, 10 Drawing Figures

116
12
22
21
112
18b
18c
18a
114
113
111
117
105
69
68
67
66
24
10b
68a
118
75
69a
84
83
67a
82
81
66a
51
74
73
76
72
71
10a
64
63
94
101
62
92
49
61
102
107
93
104
91
96
44
46
108
97

Fig. 5.
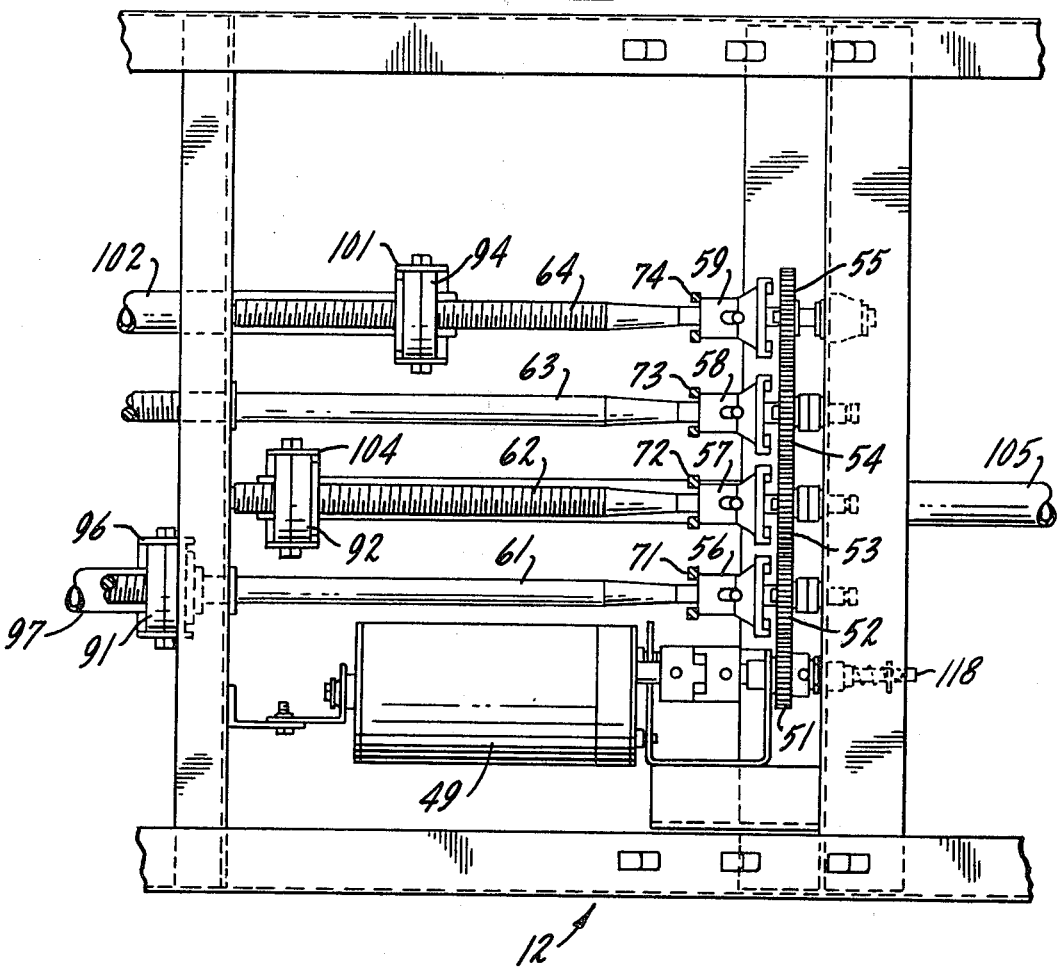
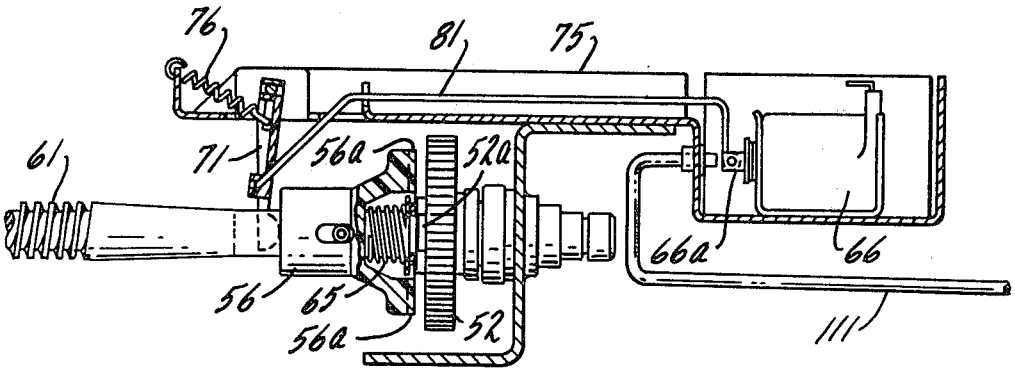
Fig. 6.

TRANSMISSION FOR ADJUSTABLE HOSPITAL BED

BACKGROUND OF THE INVENTION

This invention relates to an adjustable hospital bed having a transmission for effecting a plurality of different bed adjustments at the same time, the transmission transmitting power to the adjustment mechanisms from a single common drive.

Adjustable hospital beds are usually vertically movable so that the mattress supporting structure may be established at a selected desired height, within a range of permissible heights, from the floor. The lowermost level is most convenient when a patient is entering or leaving the bed. On the other hand, the uppermost height is generally preferred for examination and treatment of the patient. To maximize the patient's comfort the mattress support is divided into a series of individually adjustable sections or panels that may be positioned, by independently operable lift mechanisms, to provide a desired contour or configuration. For example, one lift mechanism may tilt a back section so that the patient's back and head may be raised, while another lift mechanism may adjust a knee section of the mattress support to raise the patient's knees. In addition, in many adjustable hospital beds the entire mattress supporting structure may be tilted or canted to either the trendelenburg position (head down, feet up) or to the reverse trendelenburg position (head up, feet down). The bed is adjusted to the trendelenburg position when the patient goes into shock, whereas the reverse trendelenburg position is employed for drainage.

When a hospital bed has a variety of different characteristics that may be adjusted by a single common drive, such as an electric motor or a crank, a transmission has been employed in the past to couple the common drive to a selected one of a series of output shafts, such as drive screws, each of which controls a different bed adjustment or characteristic. Power may thus be transmitted to the selected output shaft to effect rotation thereof which in turn adjusts the associated bed characteristic. Since only one output shaft can be rotated at a time, when two or more different bed adjustments must be made (for example, when it is desired to raise the patient's back and knees) the adjustments must be made one at a time. One adjustment must be completed before power can be transmitted to another output shaft to make a different adjustment. Requiring sequential operation of the adjustment mechanisms extends significantly the time needed to adjust the bed. As a result, a nurse may spend a substantial amount of time adjusting a bed for a patient. Moreover, when a patient goes into shock the bed must be placed in the trendelenburg position as soon as possible. Considerable time will be lost if, for example, the back section of the mattress support must first be lowered before the entire mattress support is tilted.

In contrast, the hospital bed of the present invention also employs a single common drive for powering a variety of different adjustments but, unlike the prior systems, any combination, or even all, of these bed adjustments may be made simultaneously.

SUMMARY OF THE INVENTION

The present invention provides, for an adjustable hospital bed, a transmission comprising at least three independently rotatable output shafts, such as drive screws, each of which controls a different bed adjustment. Drive means, such as the rotating drive produced by an electric motor, is coupled by a power actuating means simultaneously to at least two of the output shafts to effect rotation thereof, thereby making at least two different bed adjustments at the same time.

In accordance with another aspect of the invention, an adjustable hospital bed is provided which comprises a stationary lower base frame, a movable upper frame, and a mattress supporting structure which is mounted on the upper frame and has independently adjustable back and knee sections. High-low, back and knee lifting systems are provided for raising and lowering the upper frame, the back section and the knee section, respectively. There is at least one independently rotatable high-low drive screw for operating the high-low lifting system. In addition, independently rotatable back and knee drive screws are provided for operating the back and knee lifting systems, respectively. Finally, power actuating means employs drive means for rotating at least two of the drive screws simultaneously in order to operate at least two of the lifting systems at the same time.

DESCRIPTION OF THE DRAWINGS

The features of the invention which are believed to be novel are set forth with particularity in the appended claims. The invention may best be understood, however, by reference to the following description in conjunction with the accompanying drawings in which like reference numbers identify like elements, and in which:

FIG. 5 is a fragmentary top view showing some of the parts hidden in the FIG. 3 view;

FIG. 6 is a fragmentary side view, partially in section, of some of the elements of FIGS. 3 and 5 on an expanded scale;

DESCRIPTION OF THE ILLUSTRATED EMBODIMENT

Figure 1:
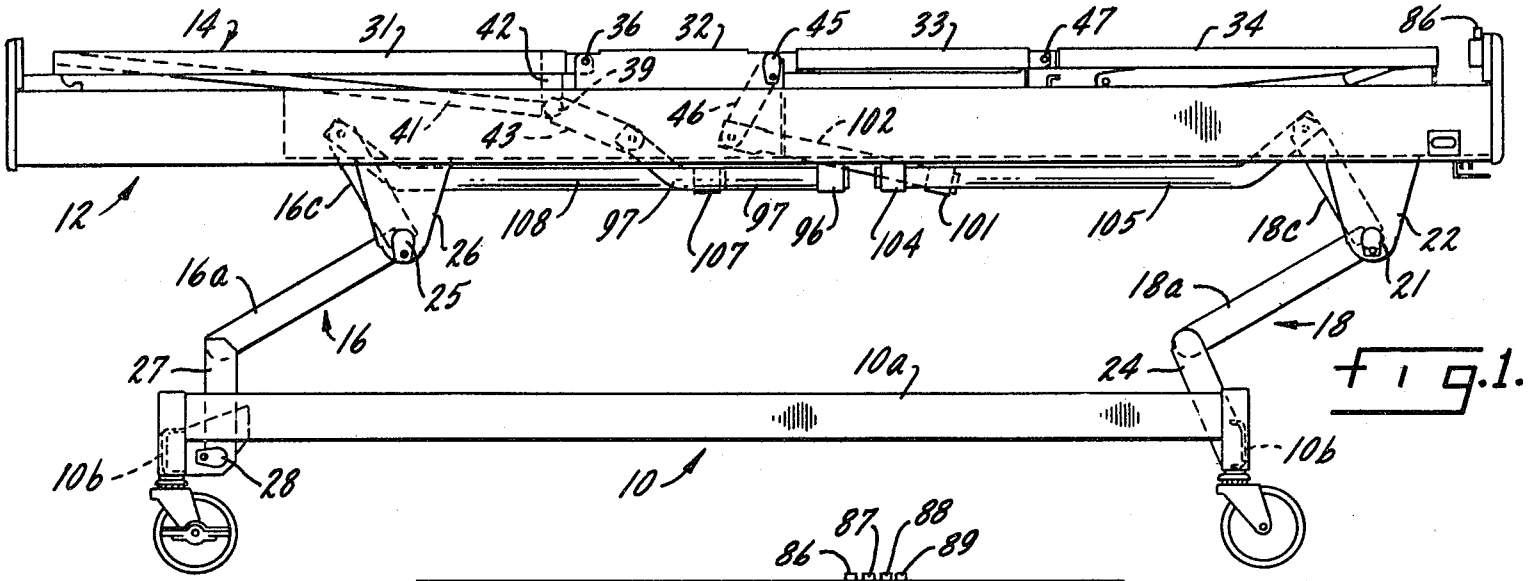
FIG. 1 is a side view of an adjustable hospital bed constructed in accordance with one embodiment of the invention, the bed being illustrated with independently operable head and foot lifting mechanisms, in the high-low lifting system, placing the bed in a normal horizontal position with the head end on the left and the foot end on the right.

The disclosed hospital bed includes a stationary or fixed lower base frame 10 (see particularly FIGS. 1 and 2), and a movable upper frame 12 on which is mounted an articulated mattress supporting structure 14. Frame 10 has a pair of longitudinal bars or rails 10*a* with a pair of transverse or cross bars 10*b* at the foot and head ends. Movable frame 12 is supported on and is vertically adjustable with respect to fixed frame 10 by means of head and foot lifting mechanisms or elevating linkage systems 16, 18, respectively, which together provide a parallelogram lifting system. It will be apparent, however, that the invention may be employed with other lifting systems, such as a trapezoidal system. Elevating linkage system 18 takes the form of a lift yoke having a pair of channel shaped long lever or lift arms 18*a* rigidly affixed to a pivot or torque tube 18*b* (see FIG. 2) which in turn is pivotally attached, by means of pivot studs 21, to a pair of brackets or lift support plates 22 rigidly secured to upper frame 12. The lift yoke also includes a pair of short lever arms 18*c* rigidly affixed to pivot tube 18*b*. The lower or free end of each lever arm 18*a* pivotally connects to a pair of brackets 24 rigidly affixed to the cross bar 10*b* at the foot end of base frame 10. It should be apparent that by moving the free or upper ends of short lever arms 18*c* to the right, as viewed in FIGS. 1 and 4, to effect clockwise rotation of yoke 18 around pivot studs 21, brackets 22 and consequently the foot end of upper frame 12 will be lowered. On the other hand, if lever arms 18*c* are moved to the left to rotate yoke 18 in a counterclockwise direction, brackets 22 and the foot end of frame 12 will be raised.

Although the drawings do not include an end view of the head end of the bed, it will be understood that head elevating linkage system 16 takes the form of a lift yoke of similar construction to yoke 18, having a pair of long lever arms 16*a* rigidly secured to a pivot or torque tube to which is also rigidly affixed a pair of short lever arms 16*c*. By means of a pair of pivot studs 25, the pivot tube is rotatable mounted to a pair of lift support plates or brackets 26 rigidly secured to frame 12. The lower or free ends of lever arms 16*a* are pivotally coupled to the upper ends of brackets 27, the lower ends of the brackets being pivotally attached to frame 10 by means of pivot studs 28. In similar fashion to the operation of yoke 18, when the upper ends of lever arms 16*c* are moved to the right (as viewed in FIG. 1) yoke 16 rotates clockwise around pivot studs 25 causing brackets 26 and the head end of upper frame 12 to descend. Conversely, when lever arms 16*c* are moved to the left, counterclockwise rotation results and the head end of frame 12 moves upwardly. The lower ends of brackets 27 are pivotally coupled to base frame 10 by studs 28 to allow the bed to assume the various positions shown in FIGS. 7–10.

Figure 2:
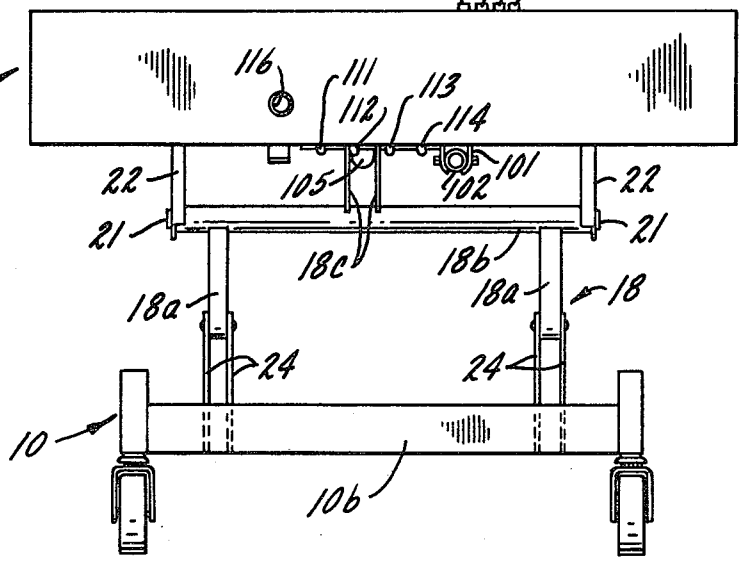
FIG. 2 is a view of the foot end of the bed of FIG. 1.

Articulated mattress supporting structure 14 is divided into four interconnected sections or panels, namely a back support section 31, a center or seat support section 32, an upper knee or thigh support section 33 and a lower knee or foot section 34. Each of the four support sections preferably takes the form of a perforated metal panel, but of course other constructions could be employed. For example, each mattress support section may constitute a bed spring. Seat support section 32 is rigidly affixed to frame 12, while one side or edge of back support section 31 is pivotally connected, by means of a pair of pivot studs 36 (only one of which is shown in FIG. 1), to seat support section 32. As will be described, adjusting means are provided for tilting back section 31 upward, with respect to fixed seat section 32, to raise the back and head of the patient occupying the bed to maximize comfort. The tilting is achieved by a torque or pivot tube 39 (see FIG. 1) secured to back section 31 by rigid structural members 41 and 42. A pair of lever arms 43 (only one of which is shown in FIG. 1) are rigidly affixed to tube 39 in order to facilitate turning of the tube. As the free ends of lever arms 43 are moved to the left, as viewed in FIG. 1, tube 39 rotates in a clockwise direction thereby tilting back support section 31 upward.

Figure 3:
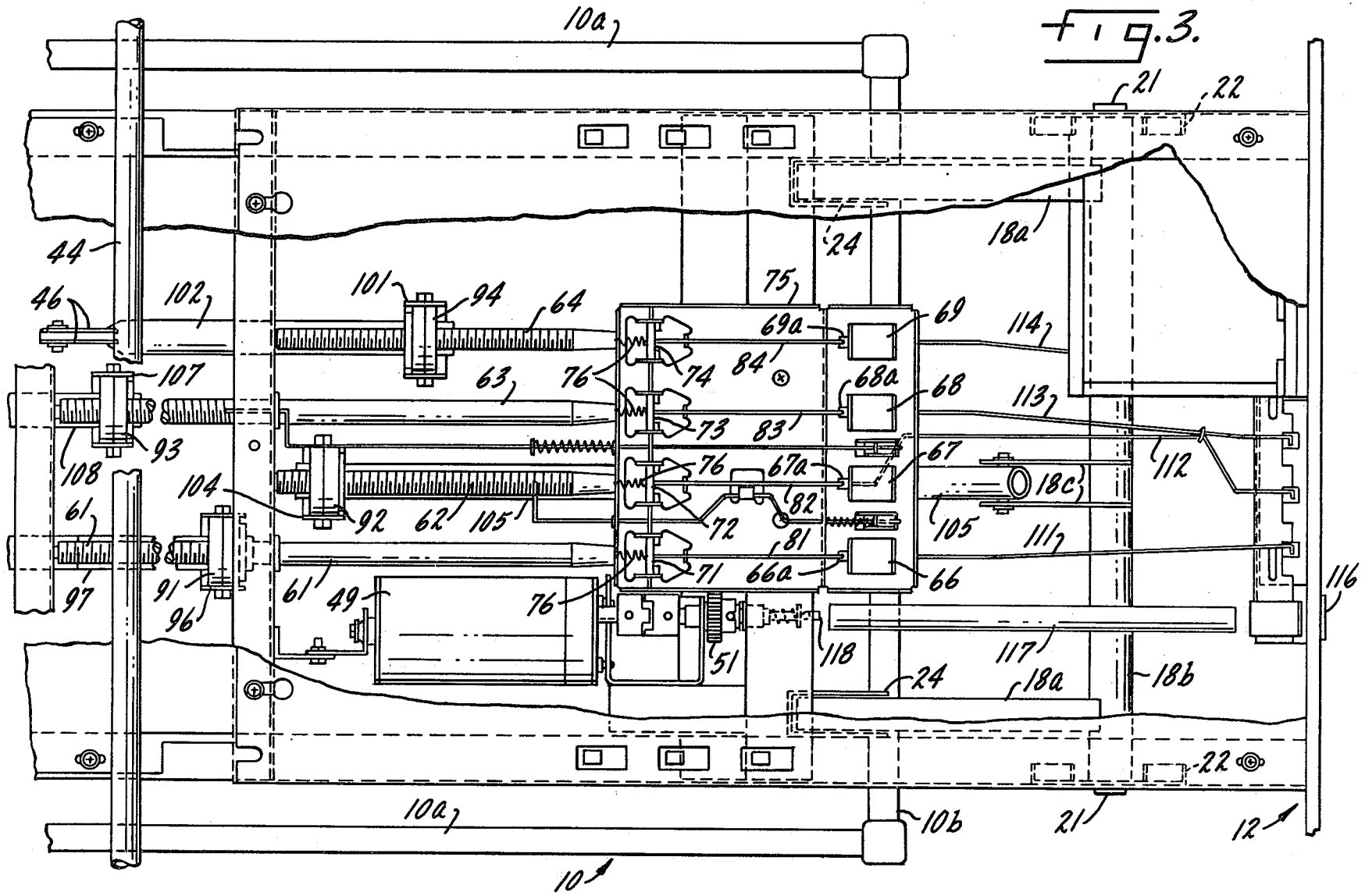
FIG. 3 is a fragmentary and partially broken away top or plan view of the bed of FIG. 1 on an expanded scale.
Figure 4:
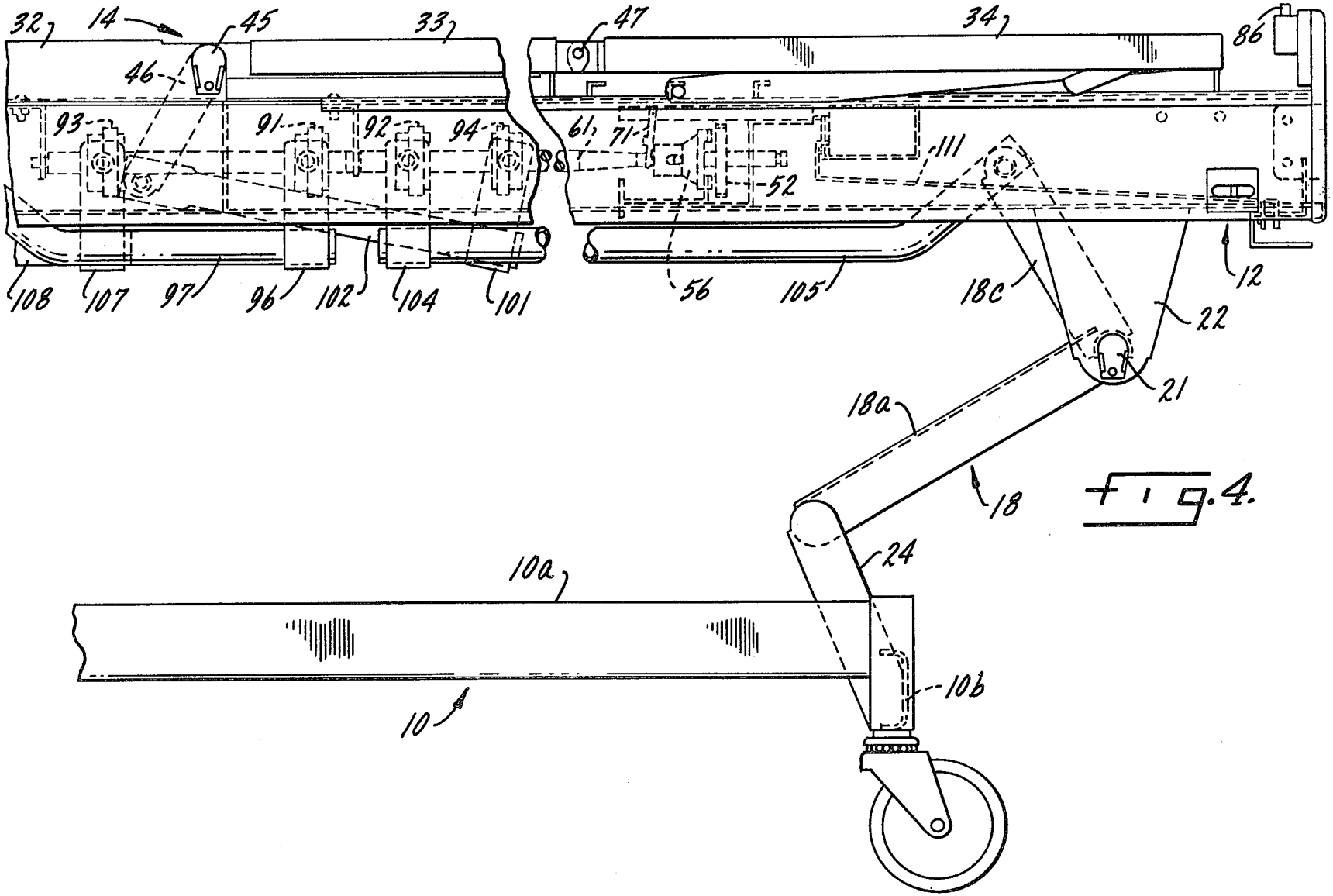
FIG. 4 is a fragmentary side view of the bed showing the side view of some of the parts illustrated in FIG. 3 and on the same scale as FIG. 3.

The adjacent sides of knee support sections 33 and 34 are pivotally interconnected by a pair of pivot studs 47, only one of which is shown in FIGS. 1 and 4. The left side of section 33 (as viewed in FIGS. 1 and 4) rigidly attaches to a torque or pivot tube 44 (see FIG. 3) which is rotatably mounted to seat support section 32 by pivot studs 45, only one of which is seen in FIGS. 1 and 4. A pair of lever arms 46 (see FIGS. 1, 3 and 4) are rigidly secured to torque tube 44 so that movement of the free ends of those arms toward the right (as viewed in FIGS. 1 and 4) results in counterclockwise pivoting of tube 44 around pivot studs 45. Upper knee support section 33 therefore tilts upward and since that section is pivotally connected to lower knee support section 34 by studs 47, the left side of section 34 will be raised. Sections 33 and 34 will thus form an inverted V in order to raise the patient's knees. Adjusting means will be described for pivoting lever arms 46 to effect a desired knee adjustment to maximize the patient's comfort.

The movable members 16, 18, 31, 33 and 34 may all be actuated, either individually or collectively, by a single reversible or bidirectional electric motor 49 (see FIGS. 3 and 5) supported on upper frame 12. When energized, motor 49 drives gear 51 which in turn rotates the four intercoupled driven gears 52–55. Each of the gears 52–55 couples, via a respective one of four clutches 56–59, to a respective one of four screw-threaded output drive shafts or drive screws 61–64, screws 61, 62 and 64 having left-handed threads while screw 63 has right-handed threads. Clutches 56–59 are normally spring biased out of engagement with their respective gears 52–55. The gears and clutches have dogs or lugs which interlock when engaged in order that gear rotation will be transferred to the associated drive screw. Attention is directed particularly to FIG. 6 which illustrates, in greater detail, the construction of clutch 56 and the apparatus for controlling it. Of course, since all of the clutches 56–59 are of similar construction only one is shown in FIG. 6 and the explanation of its construction and operation applies to all of the other clutches. The spring biasing of clutch 56 is accomplished by coil spring 65 which pushes the clutch to the left and out of engagement with gear 52. Lugs 52*a* on gear 52 and lugs 56*a* on clutch 56 interlock when the clutch is moved to the right and into engagement with the gear. Each of clutches 56–59 is actuated into engagement with its associated gear by a respective one of four solenoids 66–69 (see FIG. 3) which actuate U-shaped yokes 71–74, respectively. Each of yokes 71–74 is pivotally connected to support pan 75 (mounted on frame 12) and straddles a respective one of drive screws 61–64 and abuts the screw's clutch. Coil springs 76 bias the free ends of yokes 71–74 so that minimal pressure is normally applied to the clutches by the yokes. Actuation of each yoke in response to energization of its associated solenoid is achieved by means of linkages or rods 81–84 each of which connects a respective one of yokes 71–74 to a respective one of movable cores **66*a*–69*a* of solenoids 66–69, respectively. This construction is clearly illustrated in FIG. 6**.

When motor 49 is rotating, thereby rotating all of gears 52–55, and a selected solenoid is energized, the yoke associated with the solenoid will be pulled to the right, as viewed in the drawings, to actuate or move its clutch into engagement with its associated one of gears 52–55, thereupon causing rotation of the associated drive screw in response to the gear rotation. In short, any time motor 49 is energized, all of gears 51–55 will be rotating and by energizing a selected one or more of solenoids 66–69 a corresponding selected one or more of drive screws 61–64 will be rotated. Of course, the rotational directions of the drive screws will depend on the direction of motor 49, but since that motor is reversible it is possible to rotate each of screws 61–64 in either of its two directions. Any appropriate electrical circuitry may be employed to control the energization of motor 49 and of solenoids 66–69 to achieve the desired actuation of drive screws 61–64. A relatively simple circuit will achieve the necessary operation. The circuitry may be controlled by switches actuated by the four manually operated switch actuators 86–89 (see FIG. 2) mounted at the foot end of upper frame 12. In effect, each of switch actuators 86–89 may control the energization of a respective one of solenoids 66–69, while at the same time controlling the direction of motor 49. For example, each actuator may be a push button of the rocker type which may be depressed or rocked in one direction to energize the associated solenoid and to operate the motor in one direction, and which may be rocked in the other direction to energize the same solenoid but to operate the motor in its other direction. Preferably, the patient occupying the bed will have a remote control device for remotely controlling the circuitry for the motor and solenoids. Such a control device may either be held by the patient or removably attached to the bed.

The rotational motion of screws 61–64 is converted to linear motion by the four drive mechanisms 91–94, respectively, the movements of which cause adjustment of the bed. Each of these mechanisms includes an internally-threaded collar or clutch nut threadedly engaged on its associated drive screw. The collar or nut is held against rotation by friction imposed on it by a non-rotatable housing which surrounds the nut. The design of each nut and clutch joint is such that the total friction generated by the clutch joint will be greater than the friction generated between the drive screw threads interacting with the nut threads. Hence, as a drive screw rotates, its associated drive mechanism, namely its clutch nut and housing, will travel linearly and axially along the screw. Although not shown, pins may be provided on each drive screw to define the limits of travel of the associated drive mechanism, the pins rotating with the drive screw. When a drive mechanism travels along its drive screw to a limit of travel established by a pin, the clutch nut in the mechanism will engage the pin and its linear travel will be terminated even though the drive screw continues to rotate. The rotating pin rotates the nut within its housing, the nut thereby free wheeling, as the drive screw rotates. The nut housing, and consequently the drive mechanism, therefore remains axially stationary on the rotating drive screw. Thus, continued rotation of a drive screw after its drive mechanism has reached a limit of travel results in no axial movement of the drive mechanism. This feature precludes the need for electrical switches to de-energize the motor when the bed adjustments reach their extreme positions.

Drive mechanism 91 pivotally couples to a linkage or bracket 96 rigidly affixed to a tube 97 which in turn is pivotally connected to the free ends of lever arms 43. When drive screw 61 is rotated in the direction which causes drive mechanism 91 to move linearly to the left (as viewed in the drawings), arms 43 and torque tube 39 will be rotated in a clockwise direction and back support section 31 will be tilted upward. Opposite rotation of drive screw 61 will lower section 31 from its tilted position. Screw 61 may thus be referred to as the "back drive screw". In similar fashion, drive mechanism 94 pivotally connects to linkage or bracket 101 which is rigidly secured to one end of a tube 102. The other end is pivotally coupled to the free ends of lever arms 46 in order that rotation of drive screw 64 (which may be called the "knee drive screw") will rotate tube 44 to raise or lower the knee support sections 33 and 34.

Movement of drive mechanism 92 results in actuation of foot elevating linkage system 18 to raise or lower the foot end of upper frame 12, depending on the rotational direction of drive screw 62, referred to as the "foot high-low drive screw". More specifically, the clutch nut housing of drive mechanism 92 is pivotally coupled to a bracket or linkage 104 which rigidly connects to one end of a tube 105, the other end of which pivotally connects to lever arms **18*c*. When foot high-low drive screw 62 is rotated in the direction to move drive mechanism 92, and consequently tube 105, to the right in the drawings, lever arms 18*c* will be rotated in a clockwise direction causing the foot end of frame 12 to descend. Conversely, opposite direction rotation of screw 62 results in counterclockwise rotation of yoke 18** and raising of the upper frame's foot end.

The head elevating linkage system 16 functions in similar manner to effect independent raising and lowering of the head end of frame 12. Drive mechanism 93 is pivotally coupled to linkage or bracket 107 which rigidly attaches to one end of a tube 108, the other end being pivotally coupled to the free ends of lever arms **16*c*. When drive screw 63 (called the "head high-low drive screw") rotates in the direction required to move drive mechanism 93 to the right, tube 108 will cause clockwise rotation of yoke 16 with resultant lowering of the head end of frame 12. On the other hand, opposite direction rotation of head high-low drive screw 63 effects counterclockwise rotation of yoke 16** and raising of the frame's head end. Note that the lifting loads are divided between the two screw/nut combinations. Among other advantages, this reduces wear on the mechanical elements.

Figure 7:
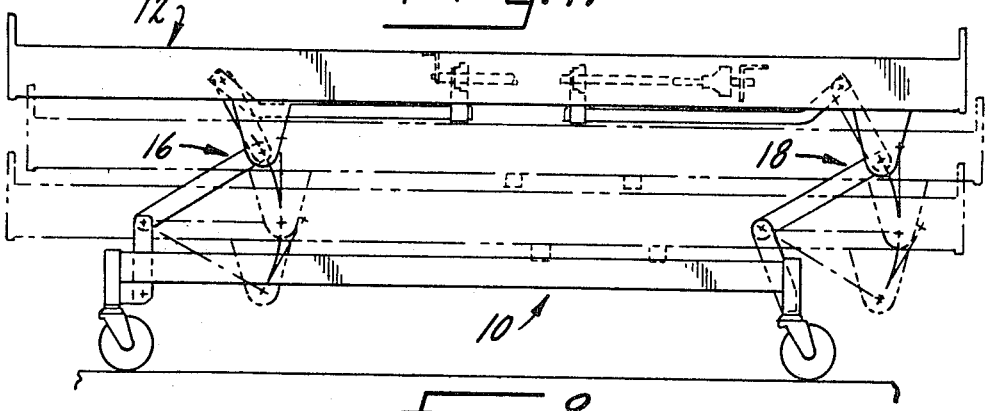
FIG. 7 illustrates the vertical movement of the bed when the upper frame is horizontal and when both the head and foot lifting mechanisms are actuated simultaneously.
Figure 8:
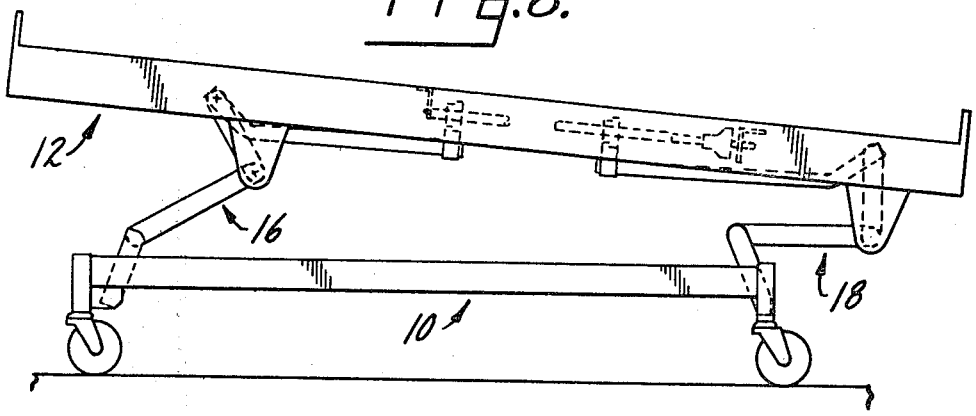
FIG. 8 depicts the manner in which the bed may be tilted to the reverse trendelenburg position when only the head lifting mechanism is operated.
Figure 9:
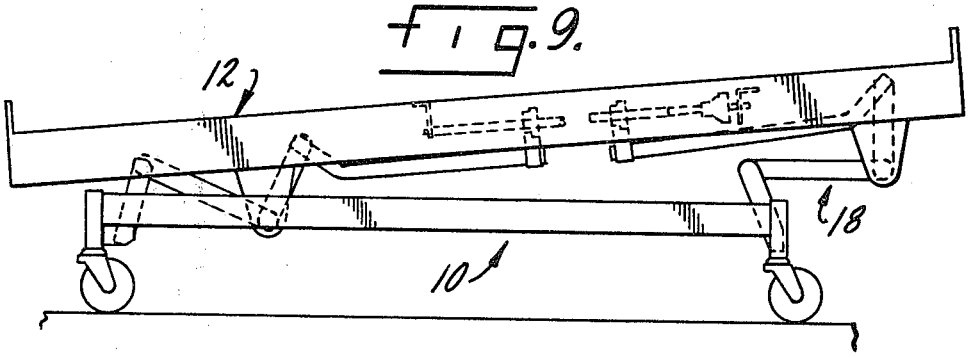
FIG. 9 shows the foot lifting mechanism in the same position as in FIG. 8, but the head lifting mechanism has been actuated so that the bed is tilted in the other direction to the trendelenburg position; and, FIG. 10 illustrates the manner in which the upper frame may be elevated or lowered while it is tilted.
Figure 10:
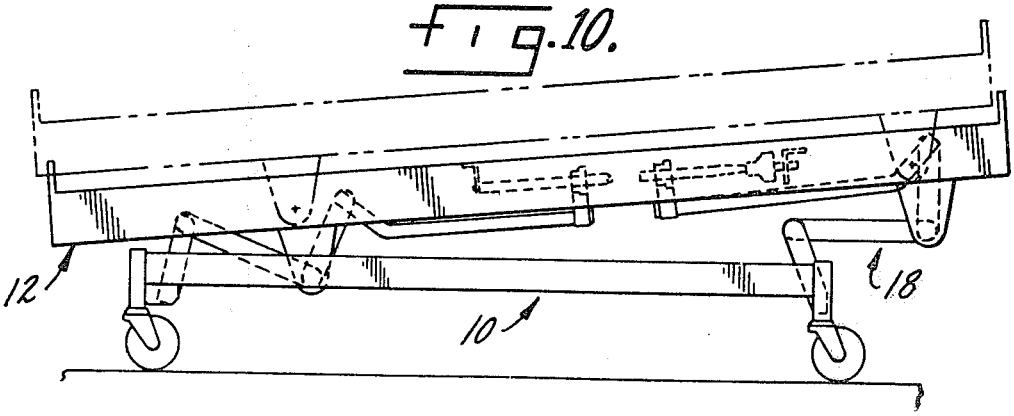

It will now be apparent that since each of lifting mechanisms 16 and 18 and its driving apparatus is entirely independent of the other lifting mechanism and its driving apparatus, the head and foot ends of upper frame 12 may each be positioned at any selected level or height, as a consequence of which frame 12 may be made horizontal or tilted and may be established at any desired level. This flexibility in operation is clearly illustrated in FIGS. 7–10. FIG. 7 depicts the operation of the bed when upper frame 12 is horizontal and both of drive screws 62 and 63 are rotating simultaneously or collectively, thereby elevating and lowering the frame in its horizontal position. When the foot drive screw 62 is not rotated but the head drive screw 63 is, the head end of frame 12 may be raised, as shown in FIG. 8, to establish the bed in the reverse trendelenburg position. FIG. 9 shows the action when the foot end of frame 12 remains at the same height as in FIG. 8 and the head drive screws 63 is rotated in the opposite direction to lower the upper frame's head end to place the bed in the trendelenburg position. FIG. 10 illustrates the operation when, starting from the tilted position of FIG. 9, drive screws 62 and 63 are rotated simultaneously, thereby elevating the entirety of frame 12 while it is tilted.

Hence, frame 12 can be tilted at any height and the height may be changed while at any tilt angle. Also the tilt angle may be changed by raising or lowering either end of frame 12 thus obtaining a desired tilt angle without changing the height of one end. Of course, the head and foot lifting mechanisms are independently operable even when the back support section 31 and the knee support sections 33 and 34 are tilted relative to seat section 32. Moreover, since all four drive screws 61–64 are independently rotatable and may be rotated individually, collectively or in any combination, several different bed adjustments may be made simultaneously, thereby saving considerable time. For example, back support section 31 may be raised at the same time that knee support sections 33 and 34 are being raised. If desired, the bed height may also be changed while the back and knee sections are being adjusted. As another example, sections 31, 33 and 34 may all be lowered simultaneously and made coplanar while at the same time the mattress support 14 is being tilted to the trendelenburg position. And all of this concurrent action is produced by a single common drive, namely motor 49.

Of course, by the proper selection of the thread directions of drive screws 61 and 64, back support section 31 and knee support sections 33 and 34 may be adjusted in a desired direction at the same time that upper frame 12 is moving in a given predetermined direction. For example, it may be desirable to lower all of sections 31, 33 and 34 to their horizontal positions (shown in FIG. 1) as frame 12 is simultaneously being raised. This would expedite the establishment of the bed in the preferred patient examination position.

In the event of a power failure, thereby precluding the operation of motor 49 and solenoids 66–69, linkages in the form of relatively rigid wires or rods 111–114 are provided to allow the nurse or attendant to mechanically depress the cores of the solenoids from the foot end of the bed. This is clearly seen in FIG. 6. By pulling linkage 111 to the right in FIG. 6, core 66*a* of solenoid 66 is pushed to the right and into the solenoid winding in the same manner as if the solenoid had been energized electrically. Gears 52–55 may then be driven by inserting a hand crank (not shown) through opening 116, at the foot end of frame 12 (see FIGS. 2 and 3), and then through tube 117, mounted on frame 12, for engagement with shaft 118 which is coupled to driving gear 51. By hand cranking shaft 118 gear 51 may be rotated to in turn rotate gears 52–55 in the same manner as if motor 49 was rotating. Hence, by manipulating selected ones of linkages 111–114 and by hand cranking shaft 118 all of the bed adjustments may be made.

In this connection, it should be realized that the invention does not require an electrically-operated or motorized bed. The invention could obviously be incorporated in a hand cranked bed which always has to be cranked when an adjustment is desired. It shold also be appreciated that the lifting mechanisms may take different forms. While a parallelogram lifting system is employed in the illustrated embodiment for the high-low adjustment, other systems, such as trapezoidal lifting system, could be used. In the illustrated parallelogram lift, the head and foot drive mechanisms travel in the same linear direction when the upper frame is being raised or lowered. With a trapezoidal lift, the two drive mechanisms would be moving in opposite directions when the upper frame is being elevated or lowered.

It should also be appreciated that the invention does not require two independently rotatable drive screws to operate the high-low lifting system. The invention may be practiced where a single drive screw operates the head and foot lift mechanisms. In other words, only three drive screws would be needed to effect independent adjustment of the high-low, back and knee lifting systems.

The invention provides, therefore, an adjustable hospital bed featuring a unique transmission which transmits power from a common drive to selected ones of a series of output drive screws, each of which controls a different bed adjustment. By simultaneously rotating at least two of the drive screws, at least two different bed adjustments may be made at the same time.

Certain features disclosed in the present application are described and claimed in the following concurrently filed copending patent applications, serial numbers, all of which are assigned to the present assignee.

While a particular embodiment of the invention has been shown and described, modifications may be made and it is intended in the appended claims to cover all such modifications as may fall within the true spirit and scope of the invention.

I claim:

1. An adjustable hospital bed comprising:

a stationary lower base frame;

a movable upper frame having side rails and a cross member connecting the side rails intermediate the ends of the movable frame;

a mattress supporting structure mounted on said upper frame and having independently adjustable back and knee sections;

a high-low lifting system for raising and lowering said upper frame;

a back lifting system for raising and lowering said back section;

a knee lifting system for raising and lowering said knee section;

at least one independently rotatable high-low drive screw mounted on the movable frame for rotation about an axis that is fixed with respect to the movable frame, the screw being extended to and supported at its one end on the cross member, the screw further being engaged by a nut that is connected to said high-low lifting system for operating said high-low lifting system;

an independently rotatable back drive screw mounted on the movable frame for rotation about an axis that is fixed with respect to the movable frame, the screw being extended to and supported at its one end on the cross member, the screw further being engaged by a nut that is connected to said back lifting system for operating said back lifting system;

an independently rotatable knee drive screw mounted on the movable frame for rotation about an axis that is fixed with respect to the movable frame, the screw being extended to and supported at its one end on the cross member, the screw further being engaged by a nut that is connected to said knee lifting system for operating said knee lifting system;

a spur gear mounted on each drive screw adjacent to the cross member and being capable of rotating thereon; each spur gear meshing with the spur gear for the drive screw that is adjacent to its drive screw;

a clutch mounted on each drive screw adjacent to the spur gear thereon, with each clutch being shiftable between an engaged condition, wherein it couples the drive screw with its spur gear so that the screw will revolve with the gear, and a disengaged condition wherein the drive screw and spur gear are disconnected and the latter can rotate on the former;

a separate solenoid actuator connected with each clutch for shifting the clutch from its disengaged to its engaged condition when the actuator is energized, each solenoid actuator being capable of being energized independently or along with at least one of the other actuators so that one or more of the drive screws may be coupled to their respective spur gears at the same time; and an electric motor mounted on the movable frame and being coupled with one of the spur gears for driving all of the spur gears simultaneously.

2. An adjustable hospital bed according to claim 1 wherein said high-low lifting system comprises independently operable head and foot lift mechanisms at the head and foot ends respectively of said movable upper frame, wherein independently rotatable head and foot high-low drive screws operate said head and foot lift mechanisms respectively, and wherein each of said head high-low, foot high-low, back and knee drive screws is coupled to a separate spur gear through a clutch that is controlled by a solenoid actuator.

3. A transmission for operating movable components of a hospital bed having a frame; said transmission comprising: a cross member extended across the frame; at least three drive screws mounted side-by-side on the frame of the bed for rotation about parallel axes that are fixed in position with respect to the frame and that further extend longitudinally with respect to the frame, one end of each drive screw being at and supported on the cross member, each drive screws being engaged by a nut and further being connected with its respective component on the bed through the nut; a spur gear mounted on each drive screw adjacent to the cross member such that it is capable of rotating on the drive screw, each spur gear meshing with the spur gear for the drive screw adjacent to its drive screw such that all spur gears are coupled and revolve in unison; a clutch mounted on each drive screw adjacent to the spur gear thereon, each clutch being capable of shifting between an engaged position wherein it couples the spur gear and drive screw for that clutch so that they will revolve in unison and a disengaged condition wherein it disconnects the spur gear from the drive screw so that the spur gear will rotate on the drive screw; a separate solenoid actuator connected to each clutch for shifting the clutch from its disengaged condition to its engaged condition, each solenoid actuator being operable independently or in conjunction with another solenoid actuator so that one or more drive screws may be coupled with their respective spur gears; a drive gear meshing with one of the spur gears; and an electric motor connected to the drive gear, whereby when the motor is energized all of the spur gears will revolve, and those drive screws that are coupled to their aligned spur gears through their respective clutches will likewise revolve.

4. A transmission according to claim 3 wherein the drive gear is a spur gear.

5. A transmission according to claim 3 wherein each clutch includes a spring that urges the clutch to its disengaged condition, and wherein the solenoid actuator of that clutch, when energized, acts in opposition to the spring of its clutch and shifts its clutch to the engaged condition.

6. A transmission according to claim 5 wherein each clutch includes an element that shifts axially with respect to the axis of the drive screw for the clutch and, when moved toward the spur gear, engages the spur gear so as to rotate with the spur gear, and a yoke engaged with the element; wherein the solenoid actuator is connected to the yoke to move the yoke such that the shiftable element is moved toward and engaged with the spur gear; and wherein the spring for the clutch urges the shiftable element away from the spur gear.

7. A transmission according to claim 3 and further comprising a hand crank that is capable of being engaged with the drive gear for manually rotating the drive gear, and a separate linkage coupled with each clutch for manually shifting the clutch to its engaged condition, the linkages and crank being accessible at one end of the frame so that the linkages may be manipulated while the crank is turned, whereby the various components of the bed may be moved by turning the hand crank.

8. For use with a hospital bed including a base frame; a movable frame located over the base frame and having foot and head ends and side rails extending between its ends, a movable back section pivotally connected to the movable frame, a movable knee section pivotally connected to the movable frame, a foot elevating mechanism for raising and lowering the foot end of the movable frame, a head elevating mechanism for raising and lowering the head end of the movable frame, a back elevating mechanism for raising and lowering the back section, and a knee elevating mechanism for raising and lowering the knee section; a transmission mounted on the movable frame for operating the several elevating mechanisms either individually or simultaneously, said transmission comprising: a cross member extended between the side rails of the movable frame intermediate the ends of that frame; a separate drive screw mounted on the movable frame for each elevating mechanism, each drive screw having one of its ends located at and supported on the cross member, the drive screws being positioned one to the side of another for rotation about parallel axes that are fixed in position with respect to the movable frame and extend longitudinally of the frame; a nut engaged with each drive screw and being coupled with the elevating mechanism for that drive screw so that when the nut moves along the drive screw the elevating mechanism changes the elevation for the bed component which it controls; a spur gear mounted on each drive screw adjacent to the cross member and further being capable of rotating relative to the drive screw, each spur gear meshing with the spur gear for the drive screw that is adjacent to its drive screw, whereby all of the spur gears will rotate in unison; a clutch mounted on each drive screw adjacent to the spur gear thereon and being capable of shifting between an engaged condition wherein it couples the spur gear and drive screw so that they will revolve together and a disengaged condition wherein it disconnects the drive screw from the spur gear; an actuator means connected to each clutch for shifting it into and holding it in its engaged condition, whereby one or more of the drive screws may be coupled with their respective spur gears; and an electric motor coupled with one of the spur gears for rotating that gear and the other gears in both directions of rotation, whereby one or more of the elevating mechanisms may be operated.

9. The structure according to claim 8 wherein each actuator means includes a solenoid and a linkage connecting the solenoid with the clutch for that actuator means.

10. A transmission according to claim 9 wherein each clutch includes a spring that urges the clutch to its disengaged condition, and wherein the solenoid for the actuator means of that clutch, when energized, acts in opposition to the spring of its clutch and shifts its clutch to the engaged condition.

11. A transmission according to claim 10 wherein each clutch includes an element that shifts axially with respect to the axis of the drive screw for the clutch and, when moved toward the spur gear on the drive screw, engages the spur gear so as to rotate with the spur gear, and a yoke engaged with the shiftable element; wherein the solenoid of the actuator means is connected to the yoke through the linkage to move the yoke such that the shiftable element is moved toward and engaged with the spur gear; and wherein the spring for the clutch urges the shiftable element away from the spur gear.

12. The structure according to claim 8 wherein the motor is coupled to one of the spur gears through a drive gear which meshes with that spur gear.

13. A transmission according to claim 12 and further comprising a hand crank that is capable of being engaged with the drive gear for manually rotating the drive gear, and a separate linkage coupled with each clutch for manually shifting the clutch to its engaged condition, the linkages and crank being accessible at one end of the movable frame so that the linkages may be manipulated while the crank is turned, whereby the various components of the bed may be moved by turning the hand crank.

* * * * *